US007891032B1

(12) United States Patent
Ryan

(10) Patent No.: US 7,891,032 B1
(45) Date of Patent: Feb. 22, 2011

(54) PILLOW TOP TRANSFORMABLE INTO GARMENT

(76) Inventor: Daria Ann Ryan, 2695 Columbia Trail, Loveland, OH (US) 45140

( * ) Notice: Subject to any disclaimer, the term of this patent is extended or adjusted under 35 U.S.C. 154(b) by 105 days.

(21) Appl. No.: 12/291,775

(22) Filed: Nov. 13, 2008

Related U.S. Application Data

(60) Provisional application No. 60/996,439, filed on Nov. 19, 2007.

(51) Int. Cl.
*A47G 9/00* (2006.01)

(52) U.S. Cl. ..... 5/490; 5/491; 5/430

(58) Field of Classification Search ..... 5/490–491, 5/652, 430, 432; D6/596–599, 601
See application file for complete search history.

(56) References Cited

U.S. PATENT DOCUMENTS 5,515,545 A * 5/1996 Becton ..... 2/113

* cited by examiner

*Primary Examiner*—Frederick Conley
(74) *Attorney, Agent, or Firm*—P. Michael Khosla

(57) ABSTRACT

A usable stuffable pillow top article formed into shape out of a wearable garment, and transformable back into the wearable garment, is disclosed. The pillow top includes removable joining means. The removable joining means are removed by user when needed, to transform the pillow top back into the wearable garment. The removable joining means define the shape of the pillow top. Optionally, the removable joining means include a removable stitch.

13 Claims, 5 Drawing Sheets

PILLOW TOP TRANSFORMABLE INTO GARMENT

TECHNICAL FIELD

The present invention relates to a pillow top transformable into a garment. More particularly, the invention is directed to a pillow top having removable joining means to transform said pillow top into a wearable garment by user. Another aspect of the invention includes a method of transforming a pillow top into a wearable garment using removable joining means to transform said pillow top to wearable garment, such removable joining means including a single-pull removable stitch. Yet another aspect of the invention includes a method of transforming a garment into a pillow top and re-transforming said pillow top back into a wearable garment, using removable joining means, such means including a single-pull removable stitch.

BACKGROUND OF THE INVENTION

Wearable garments transformable into other wearable garments or other non-wearable articles, are well known in the art of transformable articles. For example, wearable garments transformable into pillow cases are well known. More specifically, T-shirts transformable to pillow cases are well known.

The inventor of the present invention has discovered that while there are wearable garments that can be transformed into some other garment, whether wearable or non-wearable, such as a T-shirt transformable into a hat, or a T-shirt transformable into a pillow, these garments require the application of additional means by the user, such as the implementation or addition of a stitch, or some other non-removable joining means, in order to convert the garment from one form to another. What has not been known heretofore, is an article such as a pillow top, which is formed into the shape of a pillow by taking a wearable garment and including a removable joining means, and which the pillow top is transformable back into the wearable garment, such as a T-shirt, by removal of said removable joining means. There has consequently been a need in the marketplace of an article such as the pillow top formed by removable joining means, such as a chain stitch, which can be easily converted by the user into a wearable garment such as, but not limited to, a T-shirt, by an easy removal of the removable joining means to convert the pillow top into a wearable T-shirt.

The inventor of the present invention has provided an effective method of transforming a pillow top into a wearable garment by forming the pillow out of a wearable garment and by including removable joining means such as a chain stitch, which can be removed in a single pull to transform the pillow top into a wearable garment, such as a T-shirt.

The inventor of the present invention has also provided a usable, stuffable pillow top formed into shape by removable joining means out of a wearable garment, said removable joining means being removed by user when needed, to transform the pillow top into a wearable garment, such as a T-shirt.

BACKGROUND ART

U.S. Pat. No. 5,515,545, issued on May 14, 1996 to Becton, discloses a pillow tee-shirt, where in the tee-shirt is transformed into a pillowcase. This invention is different from the pillow top transformable into a garment because it does not encase a pillow that is sewn on all sides to effectively function as a stuffed or stuffable pillow, nor does it transform into a wearable garment; and U.S. Pat. No. 6,336,226 B1, issued on Jan. 8, 2002 to Garcia, discloses a convertible garment and method for providing pants that may be converted into a satchel, backpack, gun case or pillow. This invention is different from the pillow top transformable into a garment because it does not encase a pillow that is sewn on all sides to effectively function as a stuffed or stuffable pillow, nor does it transform into a wearable garment, nor does it disclose a wearable garment that is transformable into a pillow by removable joining means, and then transformable back into said wearable garment.

U.S. Pat. No. 7,165,271 B2, issued on Jan. 23, 2007 to Elen, discloses a transformable garment that can be folded within itself to transform it into a different shape for use as a pillow. The garment, a jacket, bears an integral back pack which can be used while the garment is being worn and can be transformed into either the pillow shape or into a wearable back pack. This article does not turn into a pillow, nor does it include removable joining means for turning the garment into a pillow, said removable means being removable to transform the pillow into the garment. This invention is different from the pillow top transformable into garment because it does not disclose a method of converting a T-shirt into a usable, stuffable pillow by including removable joining means, which can be easily removed by a single pull of the user's hand to transform back into a wearable T-shirt.

SUMMARY OF THE INVENTION

The invention meets the needs identified above by providing a usable, stuffable pillow top formed into shape out of a wearable garment, the pillow top being transformable into the wearable garment. In one aspect of the present invention, a usable stuffable pillow top article is formed into shape, out of a wearable garment, and is transformable back into the wearable garment. The pillow top includes removable joining means. The removable joining means are removed by user when needed, to transform the pillow top back into the wearable garment. The removable joining means define the shape of the pillow top. The removable joining means include a starting point and an ending point. The removable joining means further include a continuous extension of the removable joining means between the starting point and the ending point forming the shape of the pillow. The removable joining means further include a gap between the starting point and the ending point to facilitate the garment to be turned inside out to form a pillow cavity. The removable joining means include removable closing means located in the gap to close the pillow cavity. Optionally, the removable joining means include a removable stitch. Preferably, the removable joining means include a chain stitch openable by pulling at ending point of stitch.

DETAILED DESCRIPTION OF THE PREFERRED EMBODIMENTS

In the preferred embodiment of the present invention, a usable, stuffable pillow top is formed into shape out of a wearable garment, and the pillow top is transformable into the wearable garment. The pillow top includes removable joining means. The removable joining means are removed by user when needed, to transform the pillow top back into the wearable garment. The removable joining means define the shape of the pillow top. The removable joining means include a starting point and an ending point. The removable joining means further include a continuous extension of the removable joining means between the starting point and the ending point forming the shape of the pillow. The removable joining means further include a gap between the starting point and the ending point to facilitate the garment to be turned inside out to form a pillow cavity. The removable joining means include removable closing means located in the gap to close the pillow cavity.

In the preferred embodiment of the present invention, the removable joining means include a removable stitch.

In the preferred embodiment, the removable stitch has a starting point and an ending point, a continuous extension of the removable joining means between the starting point and the ending point forming the shape of the pillow, a gap between the starting point and the ending point to facilitate said garment to be turned inside out to form a pillow cavity; and removable closing means to close the pillow cavity.

In the preferred mode, a pillow is formed from a T-shirt including an upper body portion, a lower body portion, a middle torso portion, a pair of sleeves extending from the upper body portion, a removable stitch located in the middle torso portion, the removable stitch forming the shape of the pillow between the starting point and the ending point of the removable stitch into a square, circular, rectangular, trapezoidal or any other geometrical shape to form a pillow cavity; and after the garment is turned inside out and the pillow cavity is stuffed with a stuffing, a removable stitch is applied to close the pillow cavity and to form a usable pillow.

In yet another preferred mode, the pillow is transformed back into a T-shirt by removing the stitching located at the bottom of the pillow where the filler and/or pillow form was inserted which closes the pillow cavity, and the stuffing is removed, and the pillow is turned inside out to reveal the shape of the T-shirt, then the removable stitch in the square, circular, rectangular, trapezoidal or any other geometrical shape is removed in a single pull after cutting into the first stitch with a cutting implement to revert the pillow back into the T-shirt which can be worn after turning inside out.

Removable Stitch

One essential aspect of the invention involves the use of a removable stitch. One embodiment of a removable stitch is a chain stitch. A chain stitch is a sewing technique in which a series of looped stitches form a chain-like pattern. A chain stitch is preferred because of the ease by which it can be unraveled when a user pulls on a specific thread and clips into the first stitch. Other examples of removable stitches are the running stitch, basting stitch, and a blind hem stitch. The running stitch and basting stitch are examples of straight stitches but their ease at removing only comes with a longer stitch length. The blind hem stitch is another removable stitch but it is used to hem pants, skirts, or draperies or any other article that needs a hem. A blind stitch is another embodiment of a removable stitch that can be incorporated into the closing of the cavity. The preferred embodiment is a removable hand stitch.

Optionally, the garment can include a sweatshirt. The pillow top can also include a message, a gift or cash. The shape of the pillow top can be round, square, rectangular or any such desirable geometric shape. This invention can also include a logo on the T-shirt, such as of a university or an association.

A Specific Preferred Embodiment

In one specific preferred embodiment, a T-shirt bearing the university or sports team logo is turned inside out before the removable stitch is applied in a square shape in the torso portion of the T-shirt, leaving a small gap in the range of 5 to 10 inches, preferably 6 inches, at the bottom of the torso portion of the T-shirt. The T-shirt is turned inside out to form the shape of a pillow, which is stuffed with stuffing or a pillow form. Also added to the inside of the pillow can be a message small gift or cash for a birthday gift or emergency college money. The small gap is then closed with a removable stitch, preferably a hand stitch. The pillow is ready for use. The pillow can be manufactured in this manner and marketed commercially as a transformable pillow that converts into a T-shirt. When the user decides that it is time to convert the pillow into a T-shirt, the removable stitch closing the gap is removed, the stuffing is pulled out of the pillow cavity, the pillow is turned inside out to reveal the removable stitch used to form the shape of the pillow, the removable stitch is pulled out in one yank of the thread after cutting into the first stitch at the end of the removable stitch to result in a wearable T-shirt that can be turned inside out and worn by the user.

DESCRIPTION OF THE DRAWINGS SHOWING THE PREFERRED EMBODIMENT

FIG. 1 is the front of a pull over the head garment such as a T-shirt;

FIG. 2 is the back of a pull over the head garment;

FIG. 3 is the front of a pull over the head garment turned inside out with a removable stitch sewn in the torso portion of the garment in a square pattern to form the shape of a pillow, the removable chain stitch starting with a starting point and ending with an ending point, leaving a gap at the bottom for an opening of a pillow cavity into which stuffing and/or other items can be inserted;

FIG. 4 is the back of a pull over the head garment turned inside out with the removable stitch sewn in the torso portion of the garment in a square pattern to form the shape of a pillow, the removable stitch starting with a starting point and ending with an ending point, leaving a gap at the bottom for an opening of a pillow cavity into which stuffing and/or other items can be inserted;

FIG. 5 is the pull over the head garment with the arms and the bottom of the garment folded in;

FIG. 6 is the pull over the head garment turned right side out;

FIG. 7 is the bottom view of the pull over the head garment wherein the pillow cavity has been stuffed with a pillow filling or a pillow form;

FIG. 8 is the bottom view of the pull over the head garment wherein the gap in the pillow cavity has been closed with a removable stitch;

FIG. 9 is the pillow top transformable into garment by reversing the steps described in FIGS. 1-9.

Figure 1:
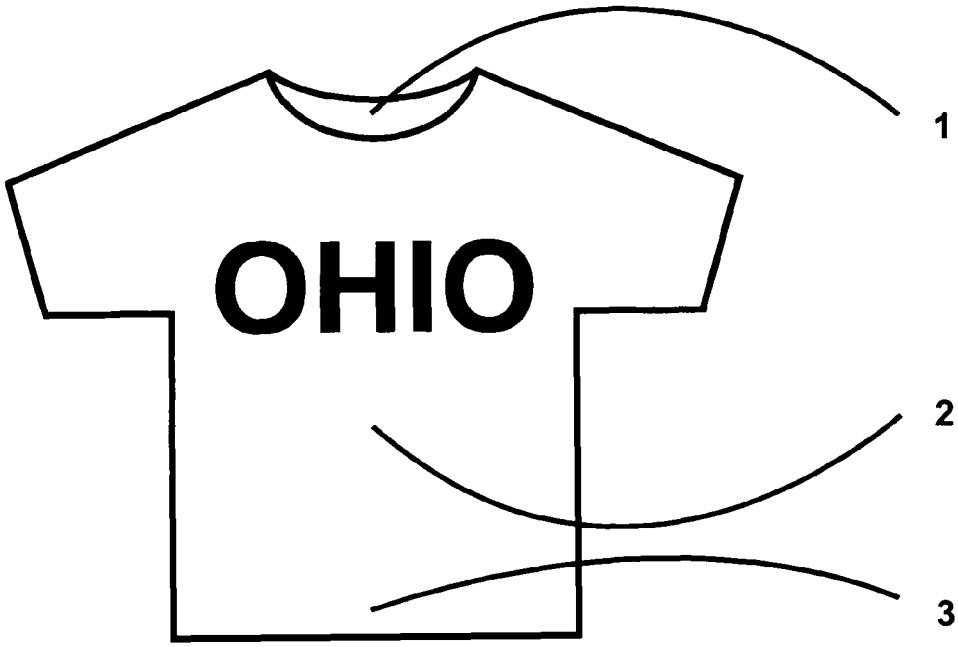
Referring to FIG. 1, in the preferred mode, a pillow is formed from a T-shirt including an upper body portion 1, a lower body portion 3, a middle torso portion 2.
Figure 2:
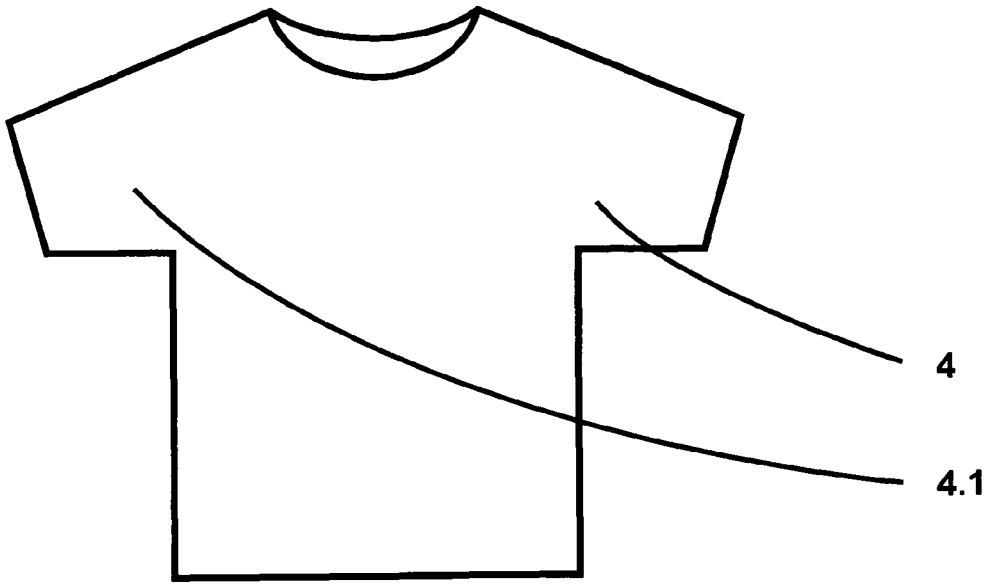
Referring to FIG. 2, in the preferred mode, a pillow is formed from a T-shirt including a pair of sleeves 4 extending from the upper body portion 1.
Figure 3:
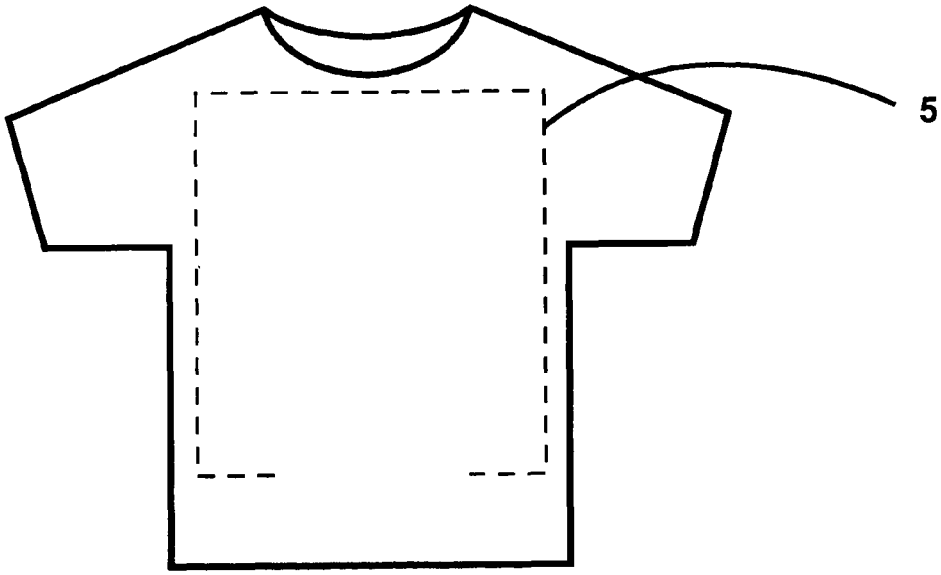
Referring to FIG. 3, in the preferred mode, a pillow is formed from a T-shirt including a removable stitch 5 located in the middle torso portion 3.
Figure 4:
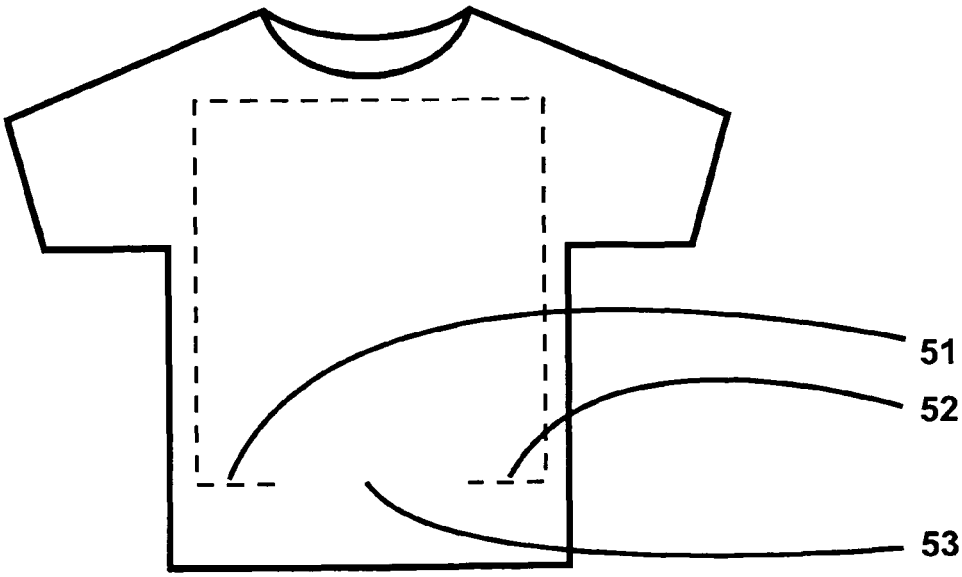
Referring to FIG. 4, in the preferred mode, a pillow is formed from a T-shirt including the removable stitch 5 forming the shape of the pillow between the starting point 51 and the ending point 52 of the removable stitch 5 into a square, circular, rectangular, trapezoidal or any other geometrical shape to form a pillow cavity. A gap 53 is formed between starting point 51 and ending point 52.
Figure 5:
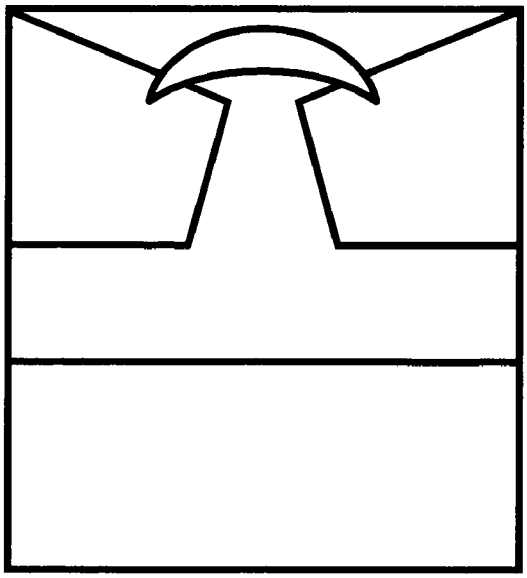
Referring to FIG. 5 and FIG. 6, in the preferred mode, a pillow is formed from a T-shirt after the garment is turned inside out to form a pillow shape 6.
Figure 6:
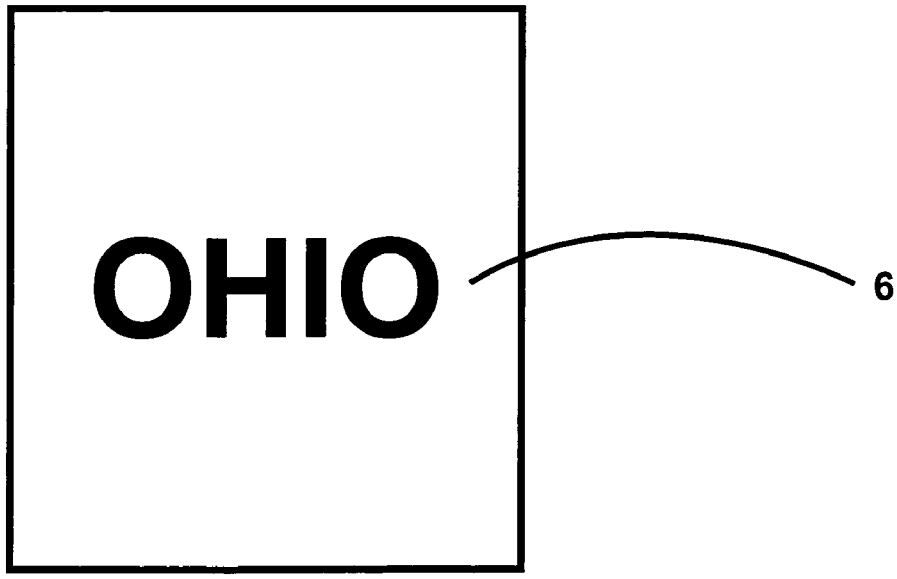
Figure 7:
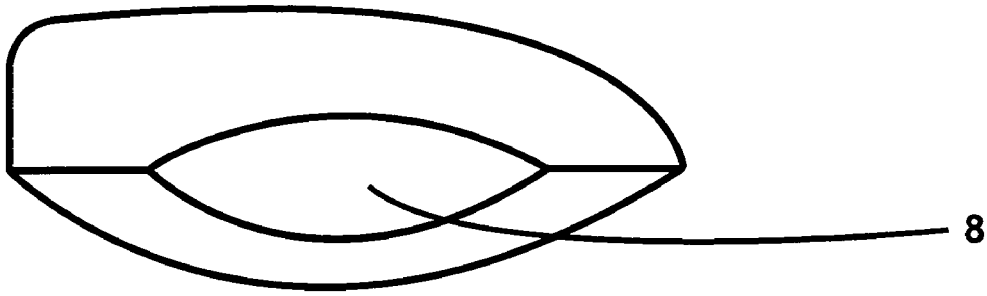
Referring to FIG. 7, in the preferred mode, a pillow has a pillow cavity 8, said pillow cavity is stuffed with a stuffing.
Figure 8:
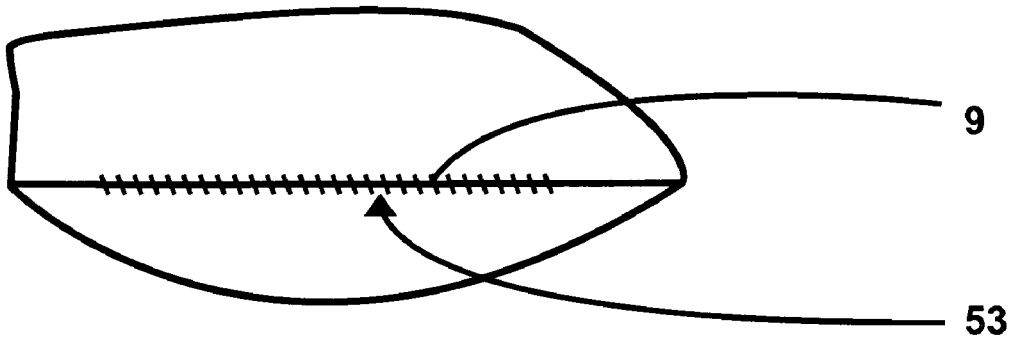
Referring to FIG. 8 and FIG. 9, in the preferred mode, a removable stitch 9 located in gap 53 is applied to close the pillow cavity and to form a usable pillow 10.
Figure 9:
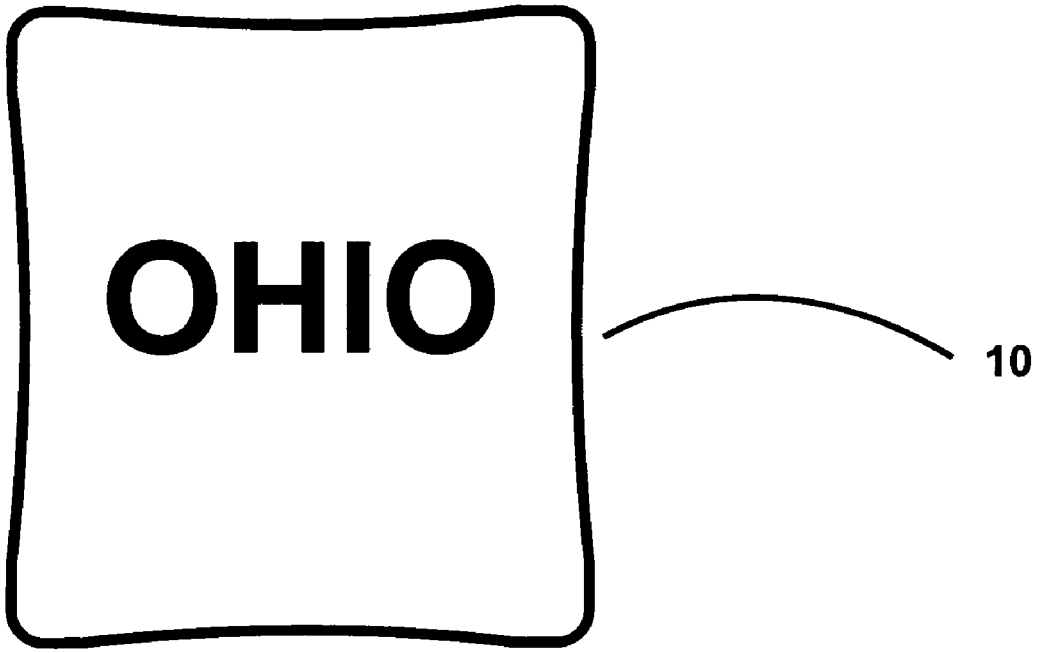

Accordingly, having thus described the invention in detail, it will be obvious to those skilled in the art that various changes may be made without departing from the scope of the invention and the invention is not to be considered limited to what is described in the specification.

What is claimed is:

1. A usable stuffable pillow top article formed into shape out of a wearable garment, and being transformable back into said wearable garment, comprising:

removable joining means, said removable joining means being removed by user when needed, to transform said usable stuffable pillow top article back into said wearable garment, said removable joining means defining the shape of said usable stuffable pillow top article, said removable joining means including:

a starting point and an ending point;

a continuous extension of said removable joining means between said starting point and said ending point forming the shape of a pillow;

a gap between said starting point and said ending point to facilitate said garment to be turned inside out to form a pillow cavity; and removable closing means located in said gap to close said pillow cavity;

wherein said pillow is formed from a T-shirt including:

an upper body portion;

a lower body portion;

a middle torso portion;

a pair of sleeves extending from the upper body portion;

removable joining means located in said middle torso portion, said removable joining means forming the shape of said pillow between said starting point and said ending point to form a pillow cavity; and removable closing means between said gap after said garment is turned inside out and stuffed with a stuffing to close said pillow cavity.

2. The usable stuffable pillow top article according to claim 1, wherein said removable joining means include a removable stitch.

3. The usable stuffable pillow top article according to claim 1, wherein said removable joining means include a removable stitch formed continuously from said starting point to said ending point, said removable stitch being removable by a single pull of a thread of said removable stitch at said ending point.

4. The usable stuffable pillow top article according to claim 3, wherein said removable stitch is a chain stitch.

5. The usable stuffable pillow top article according to claim 3, wherein said removable closing means is a stitch selected from the group consisting of hand stitch, chain stitch, running stitch, basting stitch, and blind hem stitch.

6. The usable stuffable pillow top article according to claim 1, wherein said gap is in the range of 4 inches to 10 inches.

7. A method of forming a usable stuffable pillow top article formed into shape out of a wearable garment, and being transformable back into said wearable garment, comprising the steps of:

applying removable joining means to said wearable garment, said removable joining means being removed by user when needed, to transform said usable stuffable pillow top article back into said wearable garment, said removable joining means defining the shape of said usable stuffable pillow top article, said removable joining means including:

a starting point and an ending point;

a continuous extension of said removable joining means between said starting point and said ending point forming the shape of a pillow;

a gap between said starting point and said ending point to facilitate said garment to be turned inside out to form a pillow cavity; and removable closing means located in said gap to close said pillow cavity;

turning said garment inside out to form the shape of said pillow;

stuffing said pillow with a stuffing material in said pillow cavity; and applying said closing means to close said pillow cavity.

8. The method according to claim 7, wherein said removable joining means include a removable stitch formed continuously from said starting point to said ending point, said removable stitch being removable by a single pull of a thread of said removable stitch at said ending point.

9. The method according to claim 7, further including the steps of:

removing said removable closing means;

removing said stuffing;

removing said removable joining means;

turning said garment inside out to transform said usable stuffable pillow top article into said wearable garment.

10. The method according to claim 7, wherein said removable joining means is a removable stitch.

11. The method according to claim 10, wherein said removable stitch is a chain stitch.

12. The method according to claim 7, wherein said removable closing means is a stitch selected from the group consisting of hand stitch, chain stitch, running stitch, basting stitch, and blind hem stitch.

13. The method according to claim 7, wherein said gap is in the range of 4 inches to 10 inches.

* * * * *